US008015742B2

(12) United States Patent
Zedrosser

(10) Patent No.: US 8,015,742 B2
(45) Date of Patent: Sep. 13, 2011

(54) FIREARM WITH AN ERGONOMIC RELOADING CONTROL GROUP

(75) Inventor: Ulrich Zedrosser, Steyr (AT)

(73) Assignee: Fabbrica D'Armi Pietro Beretta S.p.A., Gardone Val Trompia (IT)

( * ) Notice: Subject to any disclaimer, the term of this patent is extended or adjusted under 35 U.S.C. 154(b) by 393 days.

(21) Appl. No.: 12/245,007

(22) Filed: Oct. 3, 2008

(65) Prior Publication Data

US 2009/0249672 A1 Oct. 8, 2009

(30) Foreign Application Priority Data

Oct. 4, 2007 (IT) ..... MI2007A1913

(51) Int. Cl.
*F41A 17/40* (2006.01)

(52) U.S. Cl. ..... 42/70.04; 42/70.05; 89/138

(58) Field of Classification Search .. 42/6, 70.01–70.11; 89/138
See application file for complete search history.

(56) References Cited

U.S. PATENT DOCUMENTS 903,998 A * 11/1908 Mauser ..... 89/138
3,415,000 A * 12/1968 Koucky et al. ..... 42/70.02
3,956,967 A * 5/1976 Martz ..... 89/175
4,291,481 A * 9/1981 Hillberg ..... 42/70.02
4,549,465 A * 10/1985 Charron ..... 89/196
5,070,634 A * 12/1991 Marino ..... 42/70.01
5,113,603 A * 5/1992 Buegel ..... 42/7
7,395,747 B2 * 7/2008 Murello ..... 89/137
2006/0265925 A1 * 11/2006 Murello ..... 42/70.01
2008/0078284 A1 * 4/2008 Murello ..... 89/137
2010/0251591 A1 * 10/2010 Burt et al. ..... 42/70.01

FOREIGN PATENT DOCUMENTS

WO WO 2005050123 A1 * 6/2005

* cited by examiner

*Primary Examiner* — Stephen M Johnson
*Assistant Examiner* — Jonathan C Weber
(74) *Attorney, Agent, or Firm* — Oblon, Spivak, McClelland, Maier & Neustadt, L.L.P.

(57) ABSTRACT

A firearm includes a receiver, a lower receiver, a magazine supported by a magazine catch, a grip, a bolt and a bolt-slide, and a slide catch lever. The bolt and bolt-slide are moveable during the firing procedure of a shot. The slide catch lever automatically blocks the bolt-slide when the magazine is empty. The firearm also includes a moveable ergonomic control group that includes a control button to eject the magazine and activate the slide catch lever. The moveable ergonomic control group also includes a vertical rod, which extends above from the button as far as the slide catch lever. The moveable ergonomic control group is manually activated by the user with the same hand holding the grip.

8 Claims, 8 Drawing Sheets

12

10
110
13
18
14a
29
14'
14
III
13a
IV
16a
16b
16
111

12''
12a
16
16'

13
18
12a
14a
14'

14a
18
12b
12a
14b

12

10
13
14a
18
X
XI
16a
16
111
110
14'

12''
16'
12a
16

14a
13
18
12a
14'

14a
18
14b
12a
12b

FIREARM WITH AN ERGONOMIC RELOADING CONTROL GROUP

BACKGROUND

The present invention relates to a firearm with an ergonomic control group for reloading.

In firearms, in particular in automatic and/or semi-automatic rifles, the cartridges to be fired are contained in a specific magazine and progressively fed, by means of a moveable bolt, into a firing chamber, generally inside a barrel, where, by means of a firing mechanism activated by a trigger, the firing process is activated.

Particularly during the firing, the bolt withdraws and subsequently advances striking the ammunition brought into position by the magazine and introducing it into the firing chamber.

The capacity of the magazine of automatic rifles is generally more than 20 cartridges and consequently, in particular in the case of burst firing mode, an exact estimation on the part of the user of the number of shots still available, is extremely difficult.

To alert the user of the firearm that the last cartridge of the magazine has been fired, automatic rifles are generally equipped with a device which, if an empty magazine is inserted in the firearm, captures and withholds the bolt in a withdrawn position.

A further shot is only possible after the firearm has been reloaded with a full magazine.

Unfortunately, the reloading and operative repositioning of the firearm require various operations which must be effected by the user and which require time, slowing down the firing activity.

In particular, the user must first release the device which keeps the magazine integral with the rifle, and then remove the magazine itself to substitute it with a full magazine, subsequently the bolt, which was previously blocked with the unloading of the magazine, must be released.

In known automatic rifles consequently, the use of both of the user's hands is required for effecting the above complicated operations which, as specified above, require considerable time during which the firearm cannot be used for firing.

Furthermore, unfortunately, in known rifles, the release control of the magazine and repositioning of the slide catch lever are far from each other.

BRIEF SUMMARY

An objective of the present invention is to provide a device capable of solving the above drawbacks of the known art in an extremely simple, economical and particularly functional manner.

A further objective of the present invention is to provide a firearm with an ergonomic control group for reloading which reduces the firing stoppage due to the substitution of an empty magazine with a full one, to the minimum.

Another objective of the present invention is to provide a firearm with an ergonomic control group for reloading which controls all the elements of the firearm involved in the substitution of the magazine and housing of the first cartridge after the substitution of the magazine.

Yet another objective of the present invention is to provide a firearm with an ergonomic control group for reloading in which the control elements can be indifferently maneuvered by right-hand users and left-handed users.

A further objective of the present invention is to provide a firearm with an ergonomic control group for reloading which is particularly simple and functional, with reduced costs.

These objectives according to the present invention can be achieved by providing a firearm with an ergonomic control group.

BRIEF DESCRIPTION OF THE DRAWINGS

The characteristics and advantages of a firearm with an ergonomic control group for reloading will appear more evident from the following illustrative and non-limiting description, referring to the enclosed schematic drawings, in which.

DETAILED DESCRIPTION

With reference to the figures, these show a firearm, such as a rifle, indicated as a whole with 10, with an ergonomic control group 14 for reloading.

Figure 1:
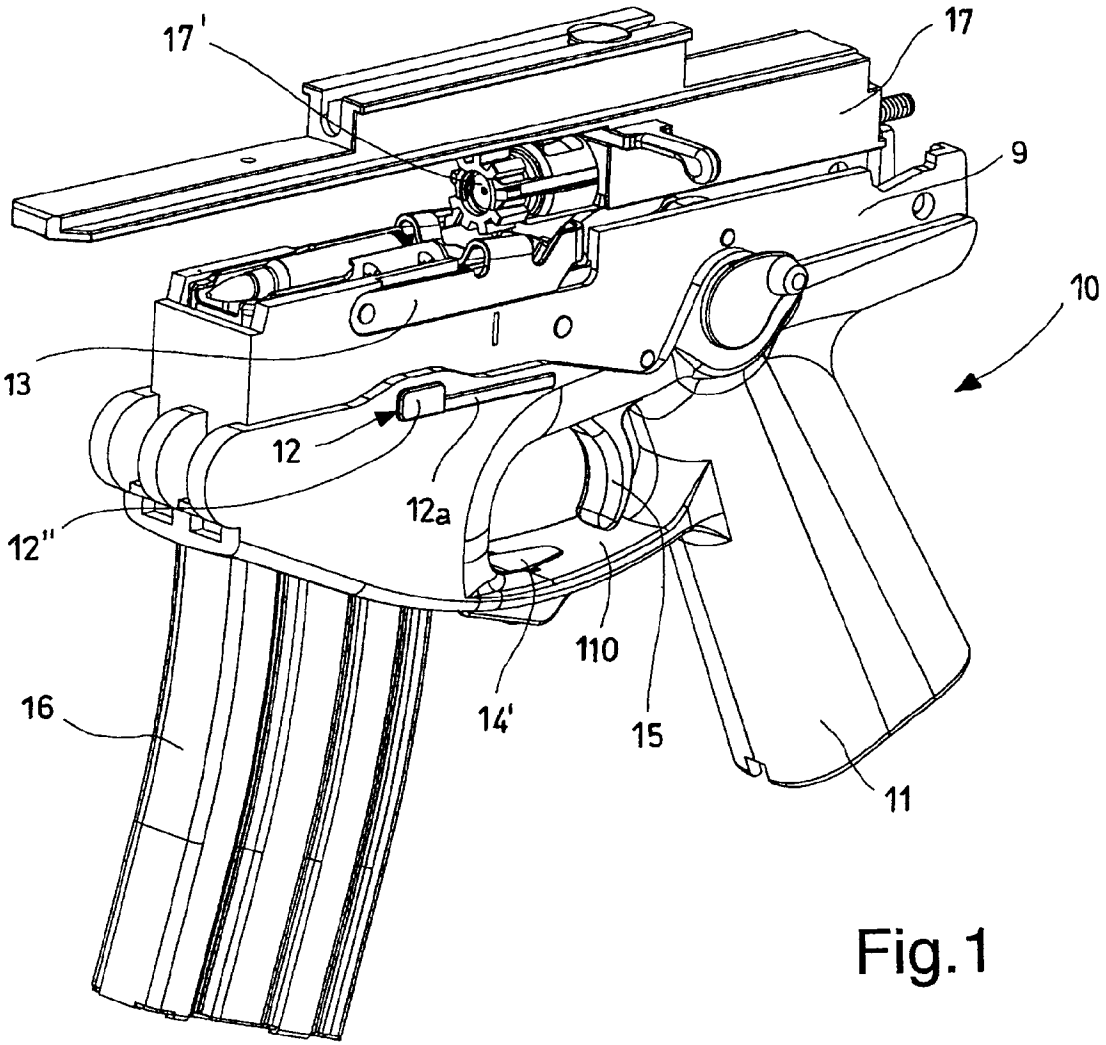
FIG. 1 is a partial cross-sectional perspective view of a firearm with an ergonomic control group for reloading, according to the present invention with the magazine charged.

In particular, said rifle 10, of which an example is shown in a partial cross-sectional perspective view in FIG. 1, comprises a receiver, not shown, a lower receiver 9, a magazine 16, a release mechanism, a bolt 17' and a bolt-slide 17, moveable during the firing procedure of a shot, a slide catch lever 13 for the selective automatic blocking of the slide 17 when said magazine 16 is empty, in addition to a moveable ergonomic control group 14 suitable for both controlling the ejection of the magazine 16 and activating said slide catch lever 13.

In particular, according to the invention, the ergonomic control group 14 can be activated by one hand alone positioned on the grip 11.

As in all known rifles, the presence is envisaged of a grip 11 and a trigger plate 110 above which there is a trigger 15 for activating the explosion procedure of a shot.

As is known, the magazine 16 comprises in its interior a spring 111 which acts from above against a moveable elevator plane 16*b* above which the cartridges 16*a* are positioned in series.

The spring 111 then progressively pushes the plane 16*b* upwards each time putting a possible cartridge in feeding or loading position.

Figures 2, 3, 3A, 4, 4A:
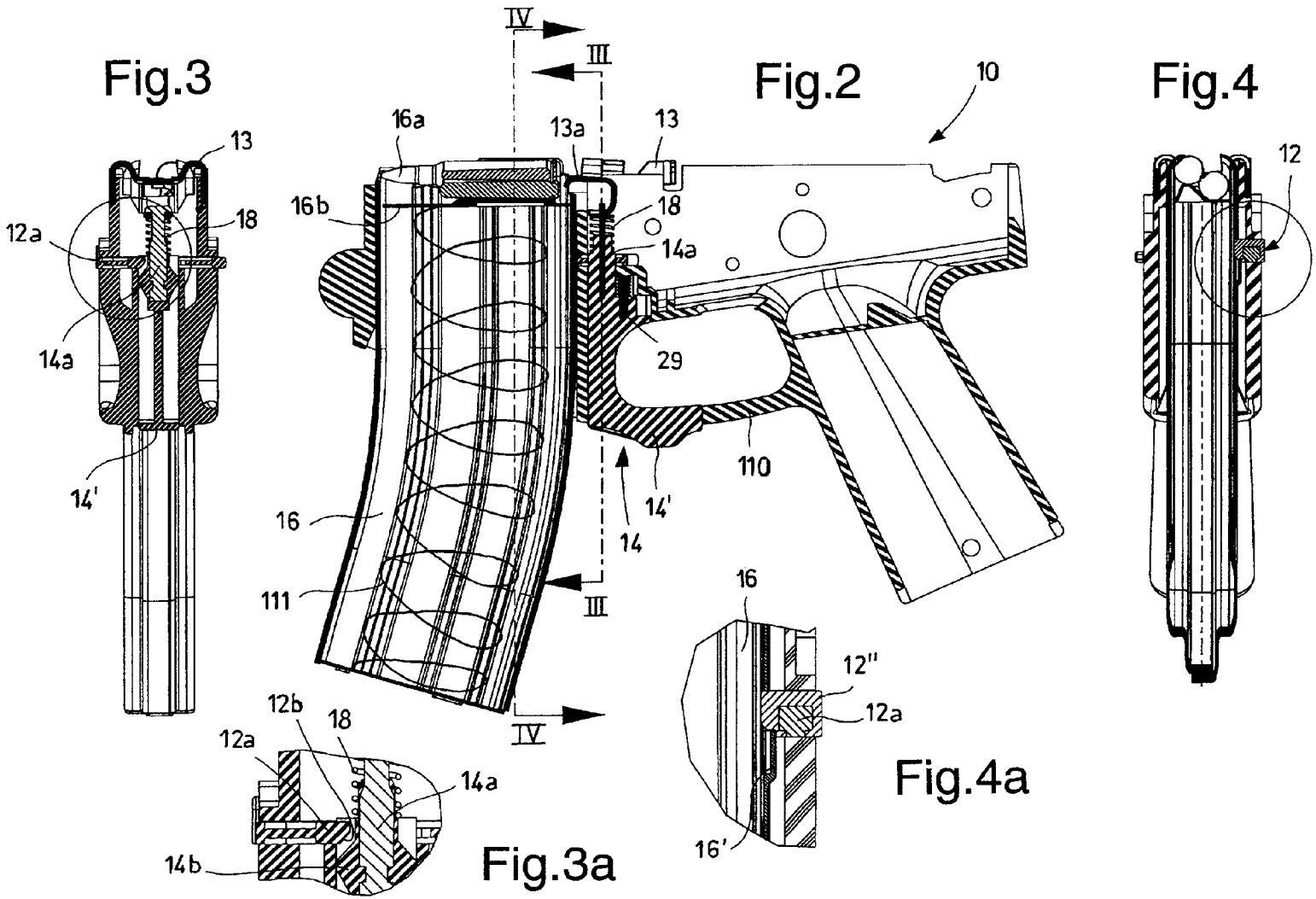
FIG. 2 is a vertical sectional view of the rifle of FIG. 1 with 2 cartridges in the magazine.
FIG. 3 is a vertical sectional view of the rifle of FIG. 2 along the section line III-III.
FIG. 3*a* is an enlarged view of a detail of FIG. 3.
FIG. 4 is a vertical sectional view of the rifle of FIG. 2 along the section line IV-IV.
FIG. 4*a* is an enlarged view of a detail of FIG. 4.

This position is shown in FIGS. 1 and 2.

The above magazine 16 is kept in functioning position inserted in the rifle 10 according to known procedures i.e. by the presence of a magazine catch 12 which laterally engages the magazine 16.

In particular, the magazine catch 12 comprises a shaped head 12" facing the interior of the rifle 10 which, when the magazine 16 is inserted, is clip-housed in a side cavity 16' situated in the outer wall of the magazine 16 itself.

This positioning is obtained by manually inserting the magazine 16 and clip-coupling the head 12" of the magazine catch 12 in its relative seat 16' of the magazine 16.

This engaged coupling is shown in FIG. 4 and in particular in FIG. 4*a*.

According to a preferred embodiment of the present invention, the combined control element 14 is arranged in a central position along an axis passing through the barrel in the trigger plate 110 which protects the trigger 15.

Figure 12:
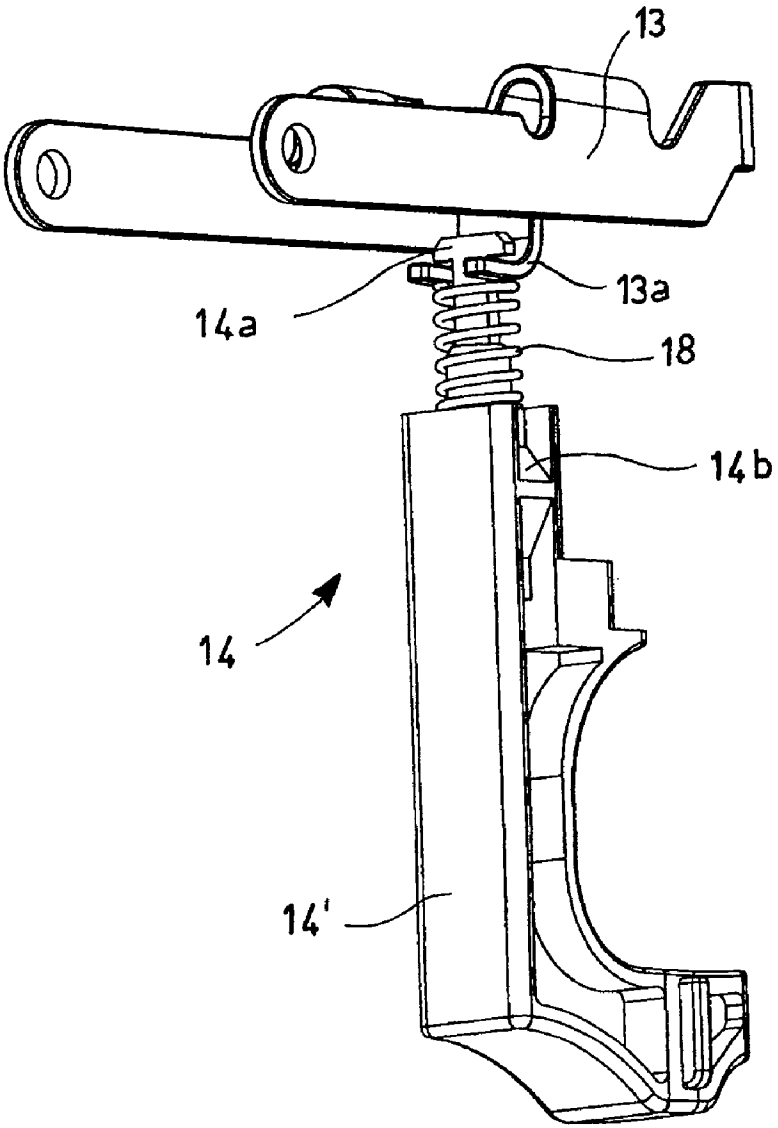
FIG. 12 is a perspective view of some details of the firearm of FIG. 1.

In particular, as shown in FIG. 12, said ergonomic control group 14 comprises a combined control button 14', vertically moveable and situated close to the trigger 15 which develops upwards from said trigger plate 110, and a vertical rod 14*a* which extends above the button 14' as far as the slide catch lever 13.

In particular, the upper end of the rod 14*a* is "T"-shaped and collaborates with a fork portion 13*a* of the lever 13 situated below the horizontal extensions of the "T".

In this way, as the fork 13*a* is in contact with the lower sides of the horizontal extensions of the "T"-shaped end, by moving the lever 13 upwards, the rod 14*a* also moves upwards.

A connection spring 18 is envisaged between the forked portion 13*a* and the upper end of the button 14'.

As can be seen in FIG. 12 and in the enlarged detail of FIG. 3*a*, close to the upper end of the button 14', there are two tilted side extensions 14*b* for activating the catch of the magazine 12, which act on an engagement surface 12*b*, tilted so as to be complementary to the tilted side extensions 14*b*, which is connected to the head 12" of the magazine catch 12 by means of a central portion 12*a*.

Figure 5:
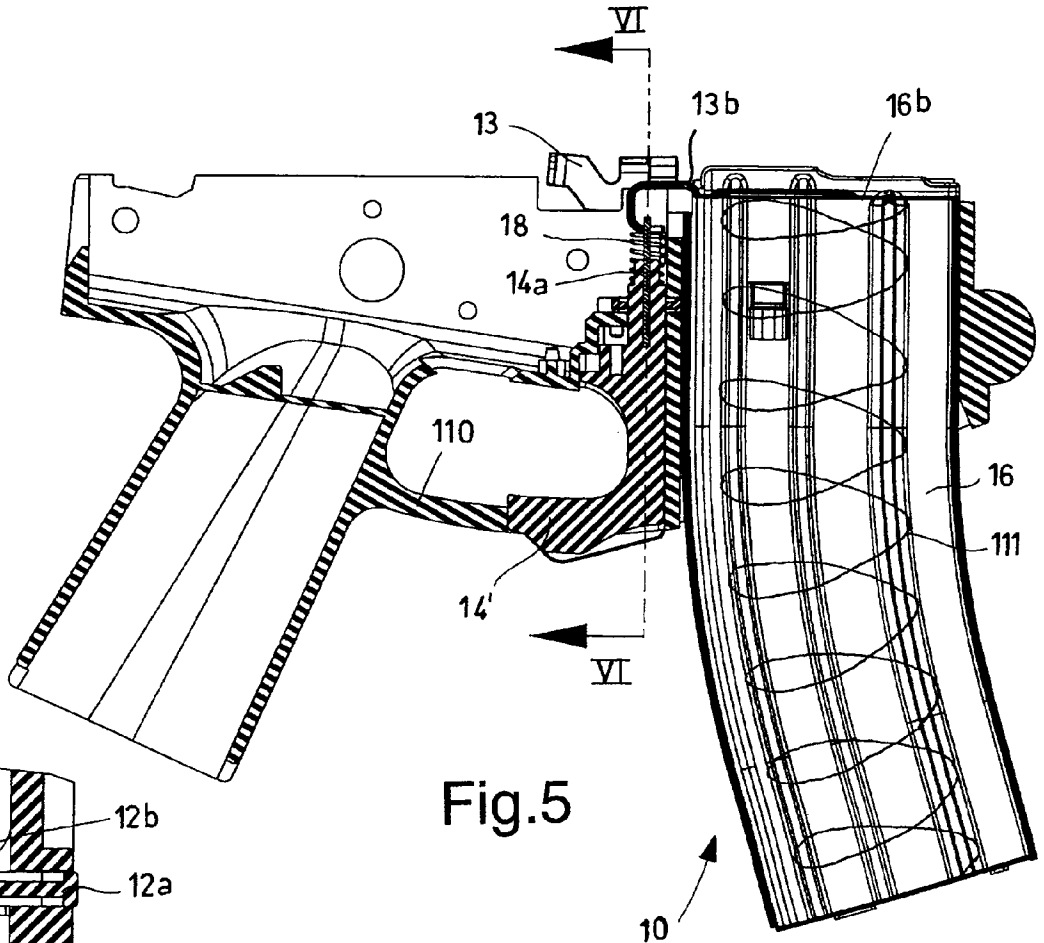
FIG. 5 is a vertical sectional view of the rifle of FIG. 1 with the magazine empty.
Figure 6A:
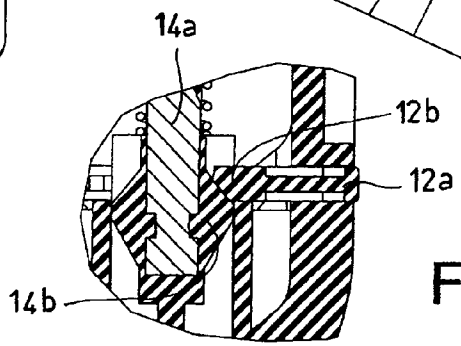
FIG. 6*a* is an enlarged view of a detail of FIG. 6.
Figure 6:
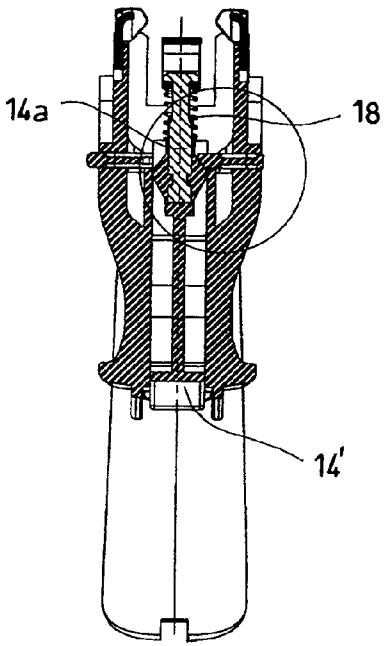
FIG. 6 is a vertical sectional view of the rifle of FIG. 5 along the section line VI-VI.

When the magazine is emptied, FIG. 5, the elevator plane 16*b* of the magazine 16 is pushed by the spring 111 against the lower surface of a portion 13*b* of the lever 13, which is then in turn pushed upwards.

In particular, as the lever 13 is hinged, the lever 13 itself effects a rotational movement which allows the fork 13*a* to be lifted from its original position, as described above.

When this automatic lifting has been effected, there is a configuration in which the rod 14*a* and the button 14' are raised, in this lifting, the spring 18 does not operate, and the extensions 14*b* of the button 14' are buffered on one side against the previously described portion 12*b* of the central portion 12*a* of the magazine catch 12.

This automatic lifting of the button 14' visually shows the complete emptying of the magazine 16 and automatic blockage of the slide 17 due to the rotation of the lever 13.

In this phase therefore the bolt-slide 17 is blocked in an open position and the magazine 16 is still assembled on the rifle. The head 12" of the magazine catch 12 in fact is still engaged with a corresponding hole 16' of the side wall of the magazine 16 and prevents its removal by falling.

Figure 7:
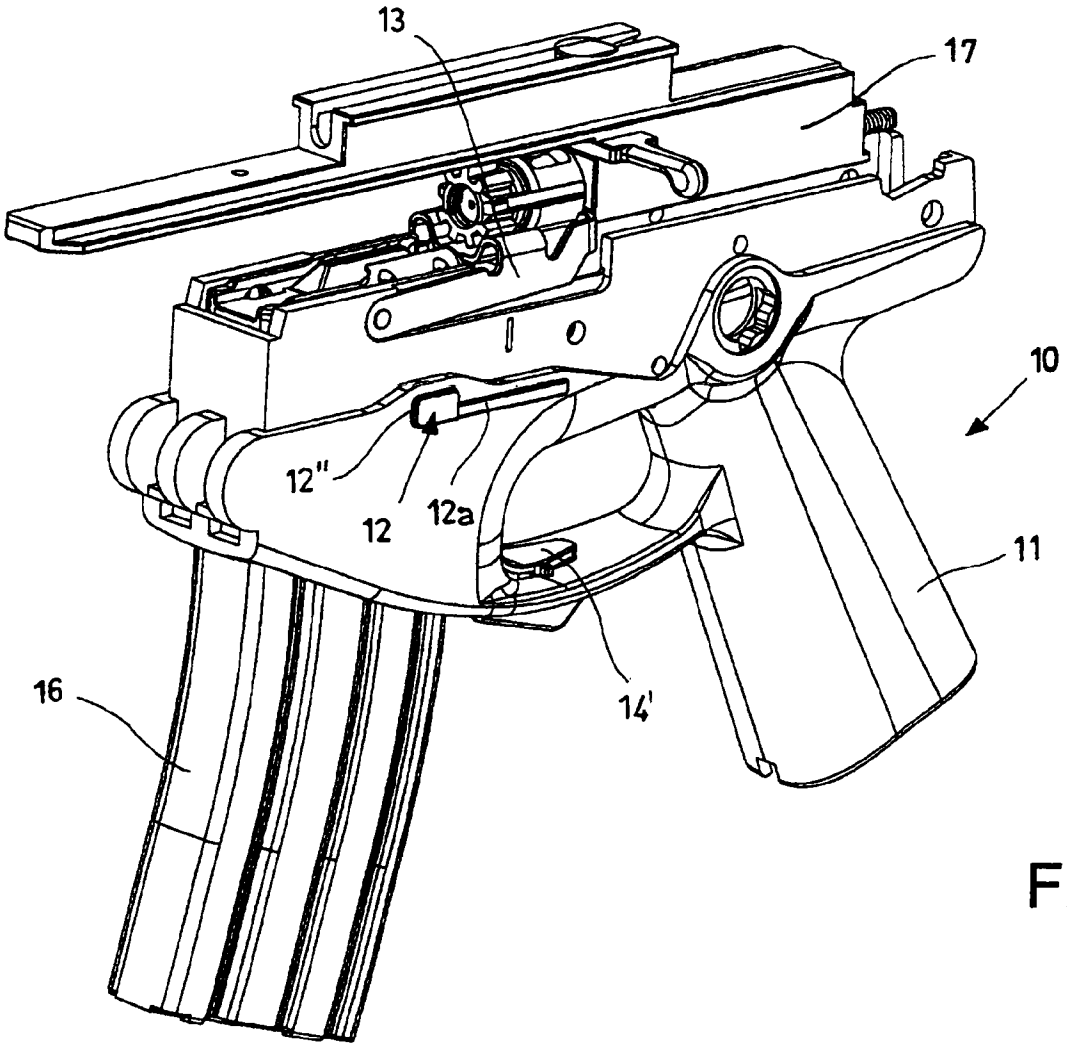
FIG. 7 is a partial cross-sectional perspective view of the firearm of FIG. 1 with the magazine empty.
Figure 8:
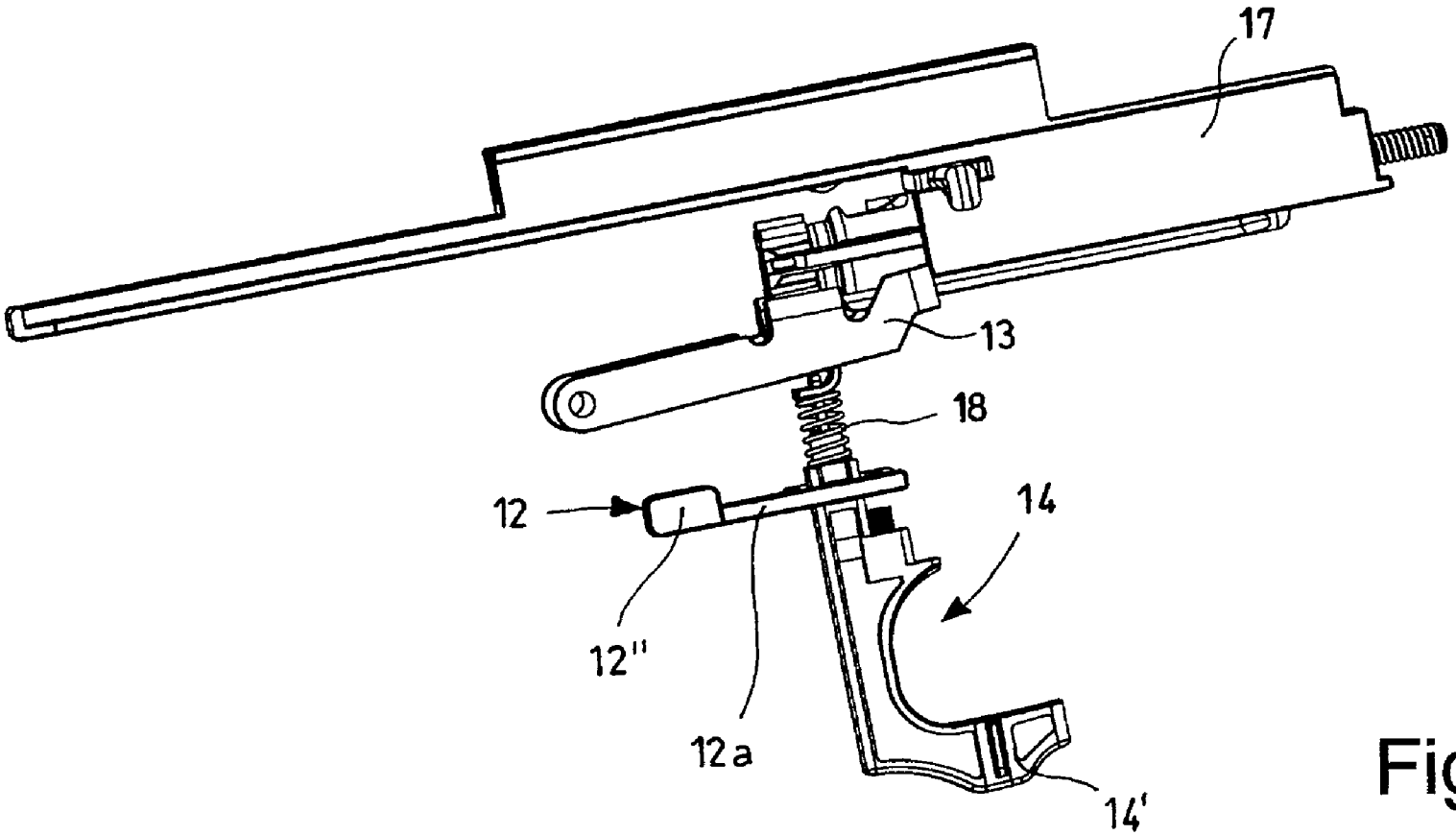
FIG. 8 is a raised side view of some elements of the rifle of FIG. 7.
Figures 9, 10, 10A, 11, 11A:
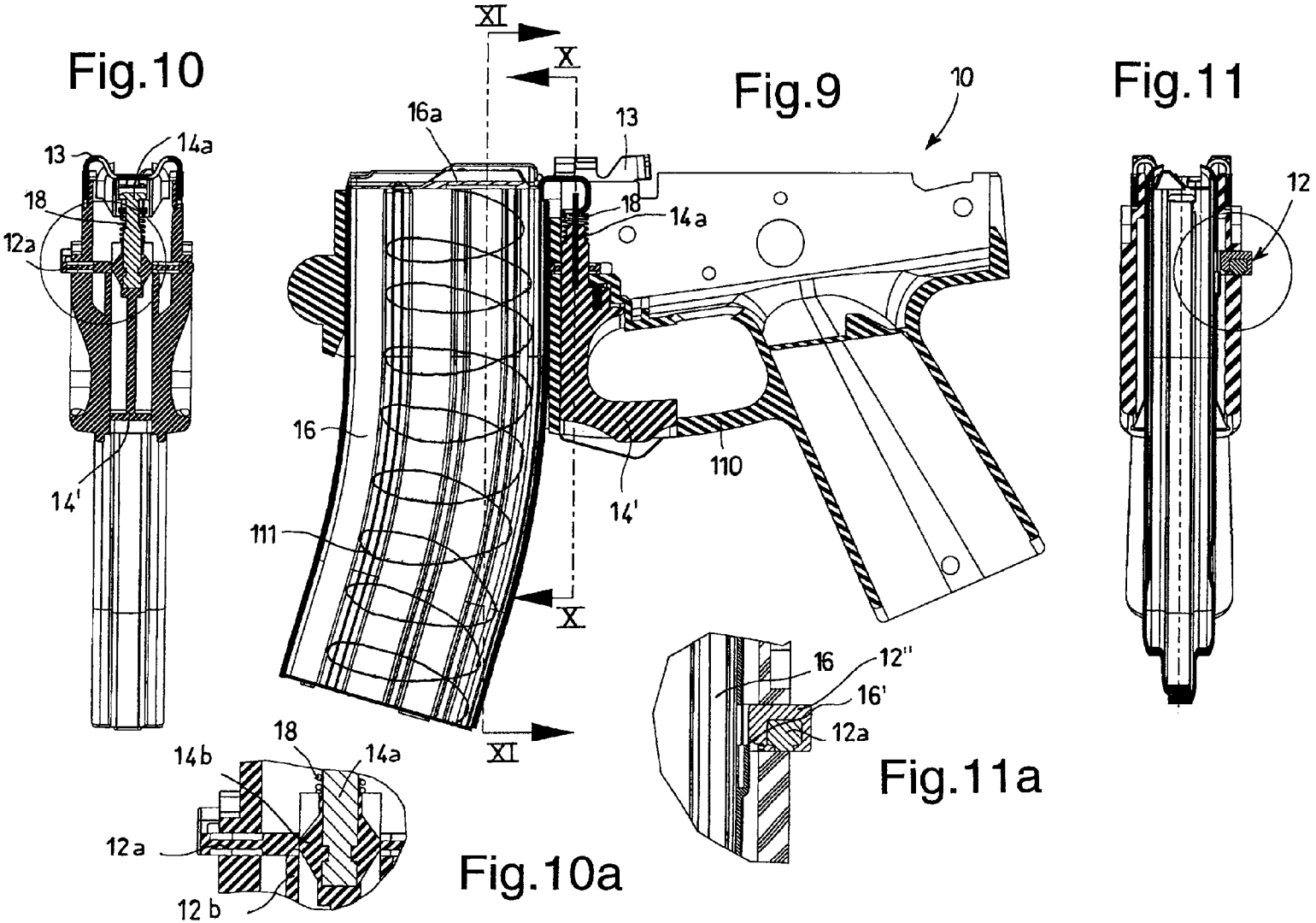
FIG. 9 is a vertical sectional view of the rifle of FIG. 1 with the magazine empty in the extraction phase.
FIG. 10 is a vertical sectional view of the rifle of FIG. 9 along the section line X-X.
FIG. 10*a* is an enlarged view of a detail of FIG. 10.
FIG. 11 is a vertical sectional view of the rifle of FIG. 9 along the section line XI-XI.
FIG. 11*a* is an enlarged view of a detail of FIG. 11.

FIGS. 7 and 8 show a schematic view of this configuration in which the lever 13 is engaged against the slide 17 and the button 14' is in a raised position with respect to the trigger plate 110.

As already mentioned, in the first upward vertical stroke section of the button 14' described above, the surfaces 12*b* of the magazine catch 12 and the portions 14*b* of the button 14' are brought into contact.

In order to unhook the magazine 16, the user at this point must intervene on the button 14' by moving it manually upwards to complete a second stroke section.

The further upward movement of the tilted surfaces 14*b* of the button 14' induces these to horizontally move the portions 12*b* of the magazine catch 12 and consequently free the seat 16' of the magazine 16 from the shaped head 12".

Under this condition the magazine 16 can be removed from the rifle 10.

This manual lifting of the button 14', which is effected with the slide catch lever 13 at a standstill, compresses the spring 18, which is situated between the lever 13 and the button 14', decoupling the fork 13*a* and the T-shaped head of the rod 14*a*, pushed upwards by the button 14' itself.

After the magazine has fallen, when the user releases the button 14', the spring 18 pushes this downwards as shown in the configuration of FIG. 5 in which the T-shaped head of the rod 14*a* is resting on the fork 13*a*.

Figure 13:
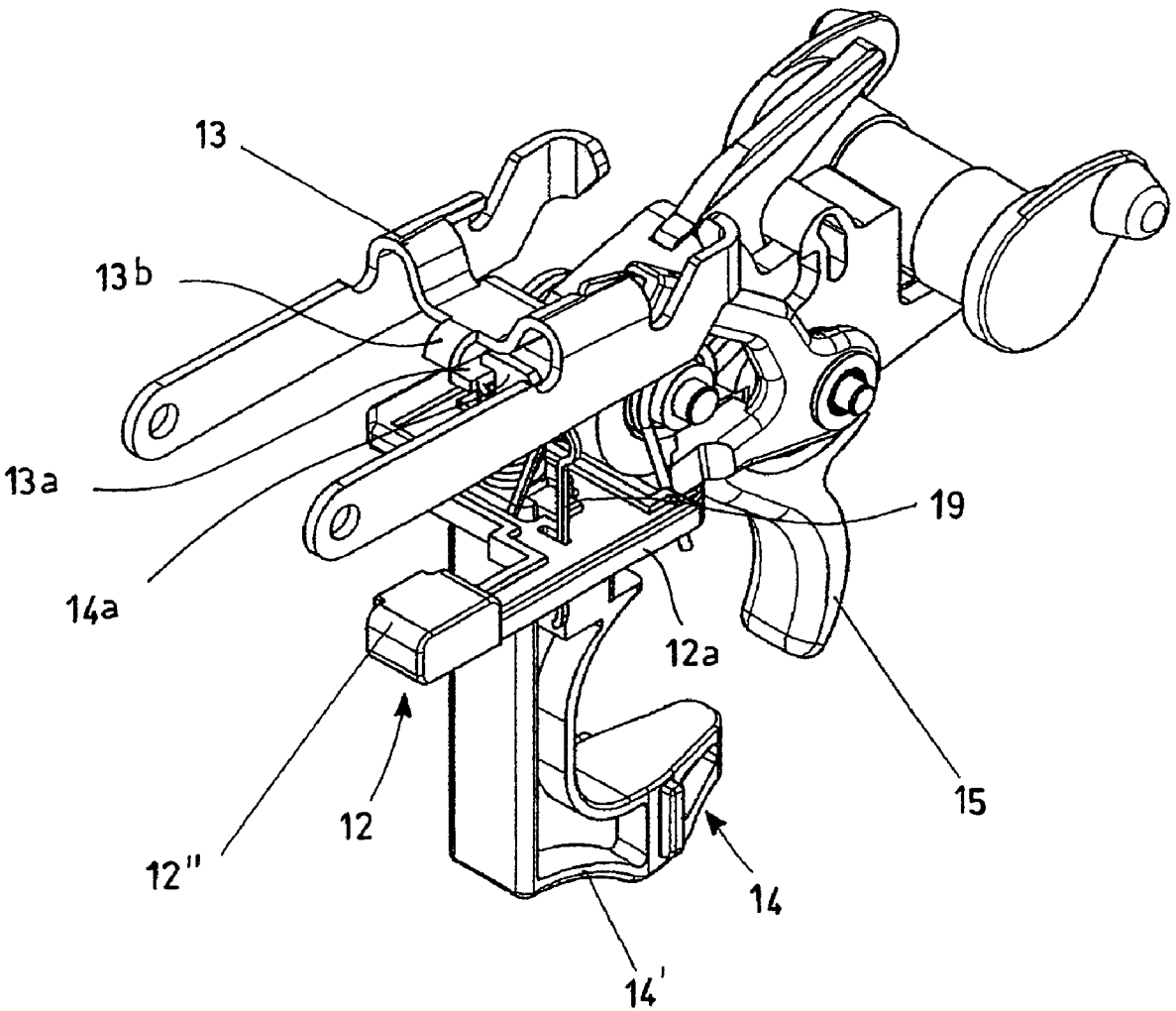
FIG. 13 is a perspective view of some details of the firearm of FIG. 1.

The magazine catch 12 also returns to rest position due to a specific spring 19 which can be seen in FIG. 13.

The insertion of a new full magazine takes place by means of known draft surfaces without involving the button. According to what is known, in fact, the magazine catch moves to allow the insertion of the magazine and springs back into position.

Finally, in order to unhook the bolt-slide 17 and introduce the cartridge into the firing chamber, the user manually lowers the button 14' which, by means of the T-shaped head of the rod 14*a*, drags downwards the fork 13*a* and consequently the lever 13.

Consequently, as described above, with a single hand acting on the button 14' it is possible to unhook the magazine catch 12 allowing the magazine 16 to be extracted by gravity, and return the bolt 17 in a position of free use by the lever 13.

Furthermore, a button spring 29, situated between the button 14' and the lower receiver, keeps the button without a clearance in its initial lowered rest position.

The spring 29 also contributes to activating the lever 13 by means of the button 14' also when the magazine is inserted, a position in which the lever cannot be lifted from the elevator as described above.

It is important in fact for the user to be able to act, by means of the button 14', on the slide catch lever 13 and on the magazine catch 12 in any of their positions.

The functioning of the device, object of the invention, can be easily understood.

By acting on the control button 14' with a single hand, in fact, i.e. the one which is activating the trigger 15, the magazine 16 can be released and the bolt 17 can be brought back into functioning position, advantageously keeping the other hand free to rapidly substitute the magazine 16, without having to control particular elements of the firearm such as the cocking handle or the like.

It can thus be seen that a firearm with an ergonomic control group for reloading according to the present invention achieves the objectives specified above.

The firearm with an ergonomic control group for reloading according to the present invention thus conceived can undergo numerous modifications and variants, all included in the same inventive concept; furthermore all the details can be substituted with technically equivalent elements. In practice, the materials used, as also the dimensions, can vary according to technical requirements.

The invention claimed is:

1. A firearm, comprising:

a receiver, a lower receiver, a magazine supported by a magazine catch, a grip, a bolt and a bolt-slide moveable during a firing procedure of a shot, a slide catch lever to automatically block said slide when said magazine is empty, and a moveable ergonomic control group, wherein said moveable ergonomic control group comprises a control button, which is vertically moveable by translation to eject said magazine and activate said slide catch lever, the button being situated near a trigger which develops from a trigger plate upwards, and a vertical rod, which extends above from said button as far as said slide catch lever, and said moveable ergonomic control group being manually activated by a user with a same hand holding said grip.

2. The firearm according to claim 1, wherein said vertical rod comprises an upper "T"-shaped end coupled with a fork portion of said lever, said fork portion being situated below horizontal extensions of said upper "T"-shaped end, said vertical rod being moveable to push said fork portion downwards under manual downward pushing of said button.

3. The firearm according to claim 2, wherein between said fork portion and an upper end of said button there is a connection spring around said vertical rod.

4. The firearm according to claim 3, wherein near the upper end of said button there are two tilted side extensions to selectively activate said magazine catch, in which one of said two tilted side extensions acts selectively, under manual upward pushing of said button and compression of said spring, against an engagement surface, tilted so as to complement said tilted side extensions connected to a shaped head of the magazine catch by means of a central portion.

5. The firearm according to claim 4, wherein said shaped head is kept facing an interior of said firearm laterally engaged with a side cavity situated in an outer wall of said magazine by a spring.

6. The firearm according to claim 1, further comprising a button spring situated between said moveable ergonomic control group and said lower receiver, to hold said button in an initial lowered rest position without clearances a clearance.

7. The firearm according to claim 1, wherein said firearm is a rifle.

8. The firearm according to claim 1, wherein the moveable ergonomic control group is configured such that, the button is vertically translated upward to a first raised position from a lowered position when the magazine is empty, the button is further vertically translated upward to a second raised position from the first raised position to eject the magazine, and the button is vertically translated downward to the lowered position from the second raised position to activate the slide catch lever.

* * * * *